US006299096B1

(12) United States Patent
Stahlecker

(10) Patent No.: US 6,299,096 B1
(45) Date of Patent: Oct. 9, 2001

(54) PROCESS AND APPARATUS FOR RENEWING THE BEARING POINTS OF A TRAVERSING ROD FOR FORMING CROSSWOUND BOBBING

(75) Inventor: Fritz Stahlecker, Josef-Neidart-Strasse 18, 73337 Bad Überkingen (DE)

(73) Assignees: Fritz Stahlecker, Bad Übrkingen; Hans Stahlecker, Süssen, both of (DE)

( * ) Notice: Subject to any disclaimer, the term of this patent is extended or adjusted under 35 U.S.C. 154(b) by 0 days.

(21) Appl. No.: 09/426,910

(22) Filed: Oct. 26, 1999

(30) Foreign Application Priority Data

Nov. 2, 1998 (DE) ..... 198 50 414

(51) Int. Cl.[7] ..... B65H 54/28; F16C 29/12; F16H 25/16

(52) U.S. Cl. ..... 242/483.5; 384/40; 74/57

(58) Field of Search ..... 242/482.8, 483, 242/483.5; 384/7, 29, 26, 40; 74/57

(56) References Cited

U.S. PATENT DOCUMENTS 2,116,254 * 5/1938 Welker ..... 403/225
5,447,795 * 9/1995 Pohn et al. ..... 428/377
5,676,324 * 10/1997 Miyagawa ..... 242/482.8
5,927,638 * 7/1999 Stahlecker ..... 242/482.8
6,027,065 * 2/2000 Stahlecker ..... 242/482.8

FOREIGN PATENT DOCUMENTS

4227313A1 2/1994 (DE) .

* cited by examiner

*Primary Examiner*—Michael R. Mansen
(74) *Attorney, Agent, or Firm*—Crowell & Moring, L.L.P.

(57) ABSTRACT

Traversing rods in textile machines producing crosswound bobbins are often made of carbon fibers for the purpose of reducing the inertia force. These kinds of traversing rods are prone to wear at their bearing points. For this reason, the traversing rod whose bearings have a distance between them which corresponds to at least twice, preferably three times the traversing stroke, is so far displaced in its longitudinal direction in order to re-new the bearing points that other areas of the traversing rod than before now act together with the bearings.

23 Claims, 1 Drawing Sheet

PROCESS AND APPARATUS FOR RENEWING THE BEARING POINTS OF A TRAVERSING ROD FOR FORMING CROSSWOUND BOBBING

BACKGROUND AND SUMMARY OF THE INVENTION

This application claims the priority of German application 198 50 414.4, filed in Germany on Nov. 2, 1998, the disclosure of which is expressly incorporated by reference herein.

The present invention relates to a process for renewing the bearing points of a thread guide supporting traversing rod made of carbon fibers or the like on a textile machine which produces crosswound bobbins, in which the distance between two adjacent bearings of the traversing rod corresponds to at least twice the traversing stroke. Preferred embodiments of the invention relate to open-end spinning machines.

Traversing rods are accelerated alternately by a traversing drive. In particular when the traversing rod has a high mass, for example when it is made of steel, the traversing drive is loaded with forces generated by high inertia force. In particular in the case of long textile machines, as is often the case with open-end spinning machines, there are furthermore considerable delays in the return motion of direction.

It has already been suggested, as exemplified by U.S. Pat. No. 5,447,795 that the traversing rods be made of carbon fibers in order to reduce the inertia force. As carbon fiber traversing rods are very inflexible, it is known from machines in practice that the bearing points for the traversing rods are no longer, as was previously the case with steel traversing rods, supported adjacent to each winding station, but rather the distance between the bearing points is increased.

Unfortunately, it has been shown that irregular wear occurs repeatedly in the case of the carbon fiber traversing rods. This is above all extremely disadvantageous because carbon fiber traversing rods are very expensive. When wear occurs in the traversing rods, replacing the bearings with replacement bearings is of no use, as replacement bearings continue to act with the worn areas of the traversing rods.

It is an object of the present invention to significantly increase the life expectancy of the traversing rods despite the occurring wear of traversing fiber carbon traversing rods.

This object has been achieved in accordance with the present invention in that the traversing rod is so far displaced in its longitudinal direction that other areas of the traversing rod then before now act together with the bearings.

The present invention is based on the knowledge that when the distance between two adjacent bearings corresponds to at least twice the traversing stroke, a maximum of half a length of the traversing rod can be worn. This can be improved with the aid of the present invention, in that the bearings, insofar as they are in order, do not have to be replaced. It is, of course, practical, when, in the case of wear in the traversing rod, the bearings are also replaced at the same time.

As, in order to renew the bearing points, the traversing rod is, according to the present invention, displaced, areas of the traversing rod, which are not yet worn, now act together with the bearings. This is achieved in that the distance between two bearings corresponds to at least twice, preferably however three times, the winding station spacing. The traversing rod can, for example, be displaced yearly by a certain amount, so that subsequently the worn areas do not act any more with the bearings, but rather fault-free areas of the traversing rod traverse in the bearings. The present invention thus achieves that, again and again, non-worn parts of the traversing rod act together with the bearings, which results in an ideal mating of material. In general, in the case of the renewal of the bearing points according to the present invention, the yarn guides are adapted to the new position of the traversing rod. This can take place, for example, in that each yarn guide on the traversing rod is moved back by the amount of one winding station spacing.

The end areas of the traversing rod can be so designed beforehand so that the above mentioned displacement of the traversing rod is permitted. It is often however, purposeful, when the ends of the traversing rod, in order to adapt them to the new position, are either lengthened or shortened. End parts of the traversing rod no longer needed can, for example, be cut off.

In the case of textile machines in operation, in particular open-end spinning machines, it is purposeful to prepare the winding area beforehand for the renewal of the bearing points according to the present invention. This can, for example, occur in that the traversing rod is provided with a reserve length at least at one of its ends. With the displacement of the traversing rod according to the present invention, the area which acts together with the traversing drive is also displaced, for example by the amount of one winding station spacing.

It can be alternatively provided that at least one end of the traversing rod is prepared for adding an extension piece. Such an extension piece must, for example, be added to the traversing rod, at the traversing drive, when as a result of the displacement according to the present invention, the area of the traversing rod acting with the traversing drive is not engaged with the drive. It is, of course, also possible to add an extension piece to the traversing rod at the end facing away from the traversing drive.

DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
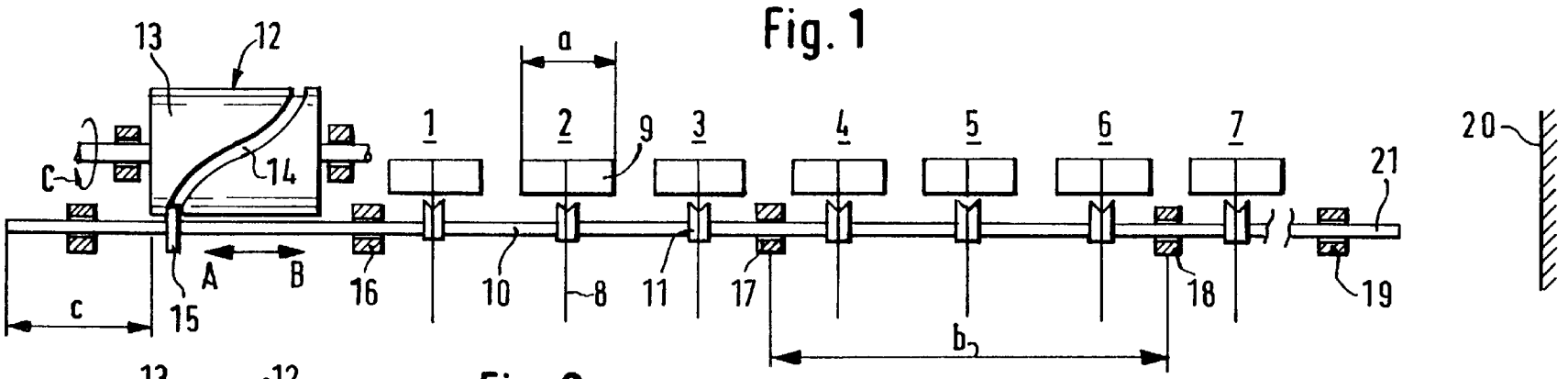
FIG. 1 is a schematic view showing a yarn winding assembly end spinning machine, with a traversing rod made of carbon fibers, which is supported at a distance of three winding stations, constructed according to a preferred embodiment of the present invention.

Seven winding stations 1 to 7 are arranged at the traversing rod 10, shown only in part in FIG. 1. The textile machine, for example an open-end spinning machine, of course comprises a plurality of further winding stations (not shown).

A yarn 8 is delivered to each winding station 1 to 7 from a spinning station (not shown), which yarn 8 is wound onto cross packages 9. For this, the traversing rod 10 carries out traversing movements according to the traversing directions A and B. At each winding station 1 to 7, yarn guides 11 are affixed to the traversing rod 10, which yarn guides 11 carry out traversing strokes corresponding to the length of the cross packages 9.

A traversing drive 12 is located at a machine end, which traversing drive 12 comprises, for example, a groove drum or a bead drum 13 having a groove curve or a bead curve 14, with which a guiding element 15 of the traversing rod 10 acts together. When the groove drum or the bead drum 13 are driven according to the rotational direction C, the traversing rod 10 executes the corresponding traversing movements with a traverse stroke a.

In the present case, the traversing rod 10 is supported in bearings 16 to 19 after every third winding station 1 to 7. The distance b between two adjacent bearings 16 to 19 can, of course, be either larger or smaller, but it should correspond to at least two traverse strokes a.

As already mentioned, the traversing rod 10 is made of carbon fibers in order to reduce the inertia force. This, however, leads to the disadvantage that a length of the traversing rod 10 in the area of the bearings 16 to 19 is subjected to a certain amount of wear, whose length corresponds to the traverse stroke a. When the distance b between two adjacent bearings 16 to 19 corresponds to at least twice, preferably even three times the traverse stroke, there are always areas on the traversing rod 10 between two bearings 16 to 19, which areas do not act together with a bearing 16 to 19. The present invention uses this to its advantage, in that for renewing the bearing points, the traversing rod 10 is displaced in its longitudinal direction so far, that other areas of the traversing rod 10 than previously now act together with the bearings 16 to 19. When, for example, the distance b corresponds to three times the winding station spacing, the displacement according to the present invention of the traversing rod 10 can be executed at least twice for the purpose of renewing the bearing points.

Figure 2:
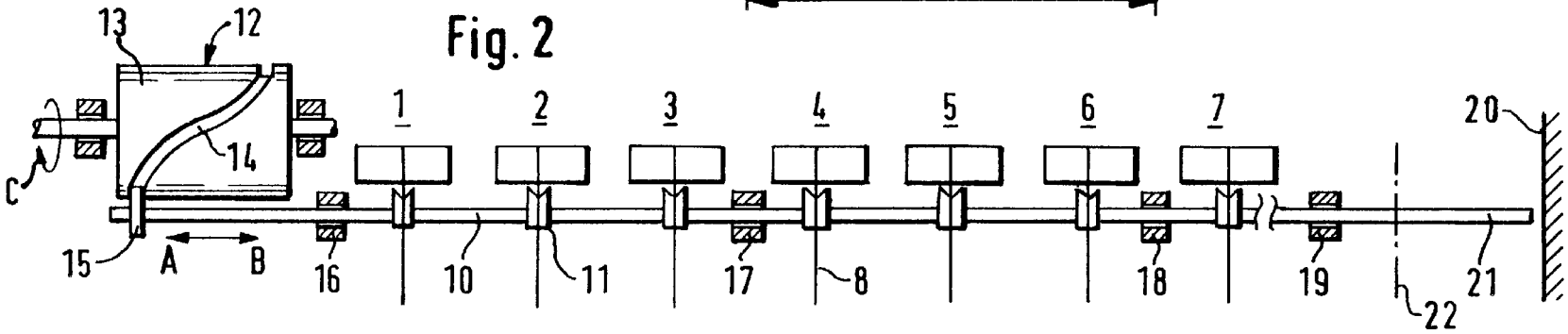
FIG. 2 is a schematic view corresponding to FIG. 1, showing the traversing rod after the renewal of the bearing points in accordance with the present invention.

In order that the traversing rod 10 can be displaced in the way described to renew the bearing points, a reserve length c (in FIG. 1 on the far left) is provided in the area of the traversing drive. This reserve length c, as shown in FIG. 2, which shows the position of the traversing rod 10 after the renewal of the bearing points, is necessary so that the traversing rod 10 can be displaced in the first place, without it leaving the area of the groove or the bead 14. The individual yarn guides 11 as well as the guiding element 15 must, of course be set back accordingly when the traversing rod 10 is displaced in its longitudinal direction.

As shown in FIG. 2, an end piece 21 in the area of the housing wall 20 is now no longer necessary. For this reason, it can be provided that the end piece 21 is cut off in the area of a suitable break-off point 22.

Figure 3:
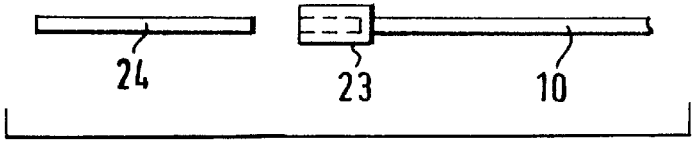
FIG. 3 is a view schematically showing an end piece of the traversing rod having a coupling piece for adding an extension piece according to preferred embodiments of the present invention.

If the above mentioned reserve length c is not required, it can be provided according to FIG. 3 that the traversing rod 10 is provided in the area of the traversing drive 12—or at the other end of the traversing rod 10—with a coupling piece 23, on which during renewal of the bearing points an extension piece 24 is coupled. It is hereby irrelevant whether the traversing rod 10 is displaced to the right or to the left. What is important is that when the bearing points are renewed, which does not necessarily mean also a replacement of the bearings 16 to 19, the traversing rod 10 is displaced enough so that other areas of the traversing rod 10 than previously now act together with the bearings 16 to 19.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A yarn winding assembly for a spinning machine, comprising:

a traversing rod supporting a plurality of yarn guides and movable with a traversing stroke to facilitate cross-winding of yarn onto respective cross packages, and a plurality of bearings slidably supporting the traversing rod, said bearings being spaced from one another by a distance corresponding to at least twice the traversing stroke, wherein said traversing rod includes a plurality of first length sections in sliding engagement with said bearings and a plurality of second sections out of sliding engagement with said bearings during first winding operations, and wherein said traversing rod includes a reserve length at one end facilitating longitudinal displacement of said traversing rod with respect to the bearings such that said first sections are out of sliding engagement with said bearings and said second sections are in sliding engagement with said bearings during second winding operations subsequent to said first winding operations.

2. A yarn winding assembly according to claim 1, wherein said reserve length is in the form of an extension piece added on one end of the traversing rod.

3. A yarn winding assembly according to claim 2, wherein said traversing rod is formed with carbon fiber material.

4. A yarn winding assembly according to claim 1, wherein said reserve length is a section of the traversing rod which is present during the first winding operations and removed for the second winding operations.

5. A yarn winding assembly according to claim 4, wherein said traversing rod is formed with carbon fiber material.

6. A yarn winding assembly according to claim 1, wherein said traversing rod is formed with carbon fiber material.

7. An open end spinning machine comprising:

a plurality of commonly driven spinning stations arranged spaced from one another along a longitudinal side of the machine, and a yarn winding assembly for winding yarn supplied by the respective spinning stations, said yarn winding assembly comprising:

a traversing rod supporting a plurality of yarn guides and movable with a traversing stroke to facilitate crosswinding of yarn onto respective cross packages, and a plurality of bearings slidably supporting the traversing rod, said bearings being spaced from one another by a distance corresponding to at least twice the traversing stroke, wherein said traversing rod includes a plurality of first length sections in sliding engagement with said bearings and a plurality of second sections out of sliding engagement with said bearings during first winding operations, and wherein said traversing rod includes a reserve length at one end facilitating longitudinal displacement of said traversing rod with respect to the bearings such that said first sections are out of sliding engagement with said bearings and said second sections are in sliding engagement with said bearings during second winding operations subsequent to said first winding operations.

8. An opening end spinning machine according to claim 7, wherein said reserve length is in the form of an extension piece added on one end of the traversing rod.

9. An open end spinning machine according to claim 8, wherein said traversing rod is formed with carbon fiber material.

10. An opening end spinning machine according to claim 7, wherein said reserve length is a section of the traversing rod which is present during the first winding operations and removed for the second winding operations.

11. An open end spinning machine according to claim 10, wherein said traversing rod is formed with carbon fiber material.

12. An open end spinning machine according to claim 7, wherein said traversing rod is formed with carbon fiber material.

13. A process of renewing bearing points of a yarn winding assembly for a spinning machine, said yarn winding assembly including:

a traversing rod supporting a plurality of yarn guides and movable with a traversing stroke to facilitate cross-winding of yarn onto respective cross packages, and a plurality of bearings slidably supporting the traversing rod, said bearings being spaced from one another by a distance corresponding to at least twice the traversing stroke, wherein said traversing rod includes a plurality of first length sections in sliding engagement with said bearings and a plurality of second sections out of sliding engagement with said bearings during first winding operations, said process comprising the following step subsequent to the first winding operations with consequent wearing of the traversing rod at said first length sections:

longitudinally adjusting the traversing rod with respect to the bearings such that said first sections are out of sliding engagement with said bearings and said second sections are in sliding engagement with said bearings during second winding operations.

14. A process according to claim 13, wherein said longitudinally adjusting the traversing rod includes changing the length of the traversing rod.

15. A process according to claim 14, wherein said changing the length of the traversing rod includes adding an extension to one end of the traversing rod.

16. A process according to claim 14, wherein said changing the length of the traversing rod includes cutting off a reserve length provided at one end of the traversing rod.

17. A process according to claim 16, wherein said traversing rod is formed with carbon fiber material.

18. A process according to claim 14, wherein said traversing rod is formed with carbon fiber material.

19. A process according to claim 13, wherein the bearings are separated from one another by a distance corresponding to at least three times the traversing stroke, said process including a second changing of the axial position of the traversing rod so that said bearings slidingly engage the traversing rod sections thereof at length sections other than the first and second length sections.

20. A process according to claim 19, wherein said traversing rod is formed with carbon fiber material.

21. A process according to claim 13, wherein the spinning machine is an open end spinning machine.

22. A process according to claim 21, wherein said traversing rod is formed with carbon fiber material.

23. A process according to claim 13, wherein said traversing rod is formed with carbon fiber material.

* * * * *